United States Patent [19]

Kukimoto

[11] Patent Number: 5,043,239

[45] Date of Patent: Aug. 27, 1991

[54] NEGATIVELY CHARGEABLE DEVELOPER AND IMAGE FORMING METHOD

[75] Inventor: Tsutomu Kukimoto, Tokyo, Japan

[73] Assignee: Canon Kabushiki Kaisha, Tokyo, Japan

[21] Appl. No.: 414,292

[22] Filed: Sep. 29, 1989

[30] Foreign Application Priority Data

Oct. 5, 1988 [JP] Japan ..... 63-249744

[51] Int. Cl.[5] ..... G03G 9/097

[52] U.S. Cl. ..... 430/100; 430/106.6; 430/110; 430/126

[58] Field of Search ..... 430/109, 110, 106.6, 430/100, 126

[56] References Cited

U.S. PATENT DOCUMENTS 4,640,882 2/1987 Mitsuhashi et al. ..... 430/126
4,758,491 7/1988 Alexandrovich et al. ..... 430/109

FOREIGN PATENT DOCUMENTS

0270063A2 6/1988 European Pat. Off. .
1347318 2/1974 United Kingdom .
2114312 8/1983 United Kingdom .
2128764 5/1984 United Kingdom .
2144555 3/1985 United Kingdom .
1402010 8/1985 United Kingdom .
2211622 7/1989 United Kingdom .

*Primary Examiner*—John Goodrow
*Attorney, Agent, or Firm*—Fitzpatrick, Cella, Harper & Scinto

[57] ABSTRACT

A negative chargeable developer for developing electrostatic latent images, comprises a toner, and hydrophoic silica fine powder treated with an agent represented by the following compositional formula (I):

(I)

wherein $R_1$ denotes an alkyl or alkoxy group, $R_2$ denotes an alkyl group having 1-3 carbon atoms, $R_3$ denotes a long-chain alkyl group, a halogen-substituted alkyl group, phenyl group, or a phenyl group having a substituent, and m, n, m' and n' are independently 0 or a position integer satisfying the relationship of $n>m$, $n'>m'$ and $n+m+n'+m'<30$.

41 Claims, 1 Drawing Sheet

NEGATIVELY CHARGEABLE DEVELOPER AND IMAGE FORMING METHOD

FIELD OF THE INVENTION AND RELATED ART

The present invention relates to a developer containing a toner and an image forming method for developing electrostatic images in an image forming method such as electrophotography, electrostatic recording and electrostatic printing, more particularly to a developer containing a negatively chargeable toner which is uniformly and strongly charged negatively to visualize a negatively charged electrostatic image through reversal development in a direct or indirect electrophotographic developing process thereby providing high-quality images, and an image forming method using the developer.

Hitherto, in electrophotographic apparatus, there has generally been adopted the normal development system wherein a non-exposed portion of a photosensitive member is developed (i.e., provided with toner particles). In this system, because the reflection light from an original is optically processed and supplied to the photosensitive member, the non-exposed portion thereof provided with substantially no reflection light (i.e., a portion corresponding to the character or image portion of the original) is developed.

Recently, the electrophotographic system has also been used for a printer as an output device for computer in addition to the production of copied images. In the case of the printer, a light-emitting device such as a semiconductor laser is turned on and off corresponding to an image signal, and the resultant light is supplied to a photosensitive member. In such case, because the printing proportion (i.e., the proportion of a printed area to the whole area of a printed sheet) is ordinarily 30 % or below, the reversal development system wherein a portion to be use for character formation is subjected to exposure and then development is advantageous in view of the life of the light-emitting device.

The reversal development system has been used in an apparatus (such as a microfilm output device) capable of outputting positive and negative images from the same original, and has also been used in an apparatus wherein the normal development system and reversal development system are used in combination in order to effect development for two or more colors.

However, the reversal development system can pose a problem as follows. Thus, in the ordinary or normal development, the transfer electric field (or electric field for transfer) has the same polarity as that of the primary charging. Therefore, even when the transfer electric field is applied to a photosensitive member after the passage of an image-supporting member such as plain paper (hereinafter referred to as "transfer material" or "transfer paper"), the effect thereof is removed by erasing exposure 6 in FIG. 1 described hereinafter. On the other hand, in the reversal development, the transfer electric field has a polarity reverse to that of the primary charging. Therefore, when the transfer electric field is applied to a photosensitive member after the passage of transfer material such as plain paper, the photosensitive member is charged in a polarity reverse to that of the primary charging, and the effect thereof cannot be removed by the erasing exposure. As a result, the portion having the reverse polarity appears as an increase in image density in the resultant image. Such a phenomenon is referred to as "afterimage caused by paper".

In order to obviate such afterimage, Japanese Laid-Open Patent Application No. 256173/1985 proposes a method wherein the current for providing a transfer electric field is reduced after the passage of paper. However, this method requires various parts such as microswitches, and the apparatus therefor becomes complicated and results in an increase in apparatus cost.

There is conceivable a method wherein the transfer electric field is reduced to a certain extent so as not to charge the photosensitive member to have the reverse polarity. However, because such a method lowers the transfer efficiency, a decrease in image quality can be caused due to transfer failure.

The reversal development can pose another problem. More specifically, because the photosensitive member is charged in a polarity reverse to that of paper, when a strong electric field is used for charging, the paper is electrostatically attached to the photosensitive member and cannot be separated therefrom even after the completion of the transfer step. As a result, the paper is subjected to the next step such as cleaning step to cause paper jam. Such a phenomenon is referred to as "paper winding".

In order to prevent the paper winding, Japanese Laid-Open Patent Application No. 60470/1981 (corresponding to U.S. Pat. No. 4353648) proposes a method wherein small insulating particles which have been charged in a polarity reverse to that of a toner image are preliminarily attached to a photosensitive member surface in order to prevent close contact between the photosensitive member and paper. However, this method is not necessarily effective in the reversal development system. This is presumably because the contact between the photosensitive member and paper at the time of separation in the transfer step of the reversal development system is closer than that in the normal development system.

U.S. Pat. No. 3,357,400 discloses another device equipped with a separation charge device or a belt separation device as a means for supplementing the separation. Such a device is effective in preventing the winding phenomenon but is not substantially effective in preventing the afterimage caused by paper. This may be attributable to a fact that the separation charging is weaker than the transfer charging and does not substantially affect the potential of the photosensitive member.

There is another method wherein the transfer electric field is reduced so as to lower electrostatic adhesion force. However, this method is liable to cause a decrease in image quality due to transfer failure, as described above. When the transfer electric field is reduced, the transfer efficiency decreases so that a postcard or an OHP film (i.e., a transparent film for an overhead projector) which has a relatively poor transfer characteristic cannot be used satisfactorily as a transfer material. Further, when the transfer electric field is reduced, there occurs "partially white image (e.g., hollow characters)", a kind of transfer failure, with respect to a portion (i.e., edge development portion) such as an image contour portion or line image portion at which developer particles are liable to be collected. The reason for this may be considered that a larger amount of developer particles are attached to the edge development portion as compared with a normal portion and the developer particles are liable to agglomerate, whereby the responsiveness to the transfer electric field is lowered. As a result, a problem occurs that it is difficult to obtain a high-quality image faithful to a latent image.

In order to form a visible image of a high image quality in a method using a dry toner, it is necessary that the toner has a high fluidity and also a uniform chargeability. For this purpose, fine silica powder has been mixed with the toner. The silica fine powder is however hydrophilic by itself so that the toner mixed with the silica fine powder and having the fine silica powder attached to the toner particles is liable to agglomerate due to moisture in air to result in a lower fluidity and also a decrease in chargeability of the toner due to moisture absorption by the silica fine powder.

For this reason, it has been proposed to use hydrophobicity-imparted silica fine powder as disclosed by Japanese Laid-Open Patent Applications Nos. 5782/1971, 47345/1973, 47346/1973, 120041/1980 and 34539/1984. More specifically, there has been used, for example, hydrophobicity-imparted silica fine powder which has been obtained by reacting fine silica powder with an organic silica compound, such as dimethyldichlorsilane or hexamethyldisilazane to substitute an organic group for the silanol groups or the silica powder surface, or silica fine powder surface-treated with silicone oil.

Among the above, silicone oil treatment is preferred as a hydrophobicity-imparting treatment for providing treated silica powder which has a sufficient hydrophobicity and provides a toner with an excellent tranferability when mixed with the toner. However, as the silicone oil is a polymer substance, silica powder causes agglomeration during the hydrophobicity-imparting process, and a part thereof remains in the form of agglomerates in sizes of several tens of microns after being dispersed in the toner. Such agglomerates are consumed for development of image parts because they have the same negative chargeability as the toner, thereby to result in white spots which degrade the image quality.

SUMMARY OF THE INVENTION

A generic object of the present invention is to provide a developer and an image forming method having solved the above problems.

An object of the present invention is to provide a negatively chargeable developer which is capable of forming high-quality images when used in an image forming system such as reversal development system wherein a transfer step using a low transfer electric field is required, and includes a transfer step.

A further object of the present invention is to provide an image forming method wherein a phenomenon such as the above-mentioned "afterimage caused by paper", "paper winding" or "partially white image (e.g., hollow characters)" is prevented or suppressed.

A further object of the present invention is to provide an image forming method and a developer capable of providing a high-quality image without fog even on a thick transfer paper.

A further object of the present invention is to provide a negatively chargeable developer which is stable under various environmental conditions including high temperature-high humidity and low temperature-low humidity conditions, and is capable of constantly exhibiting a good characteristic.

A further object of the present invention is to provide a negatively chargeable developer and an image forming method suitable for developing a digital latent image used in an image forming apparatus such as digital copying machine and laser beam printer.

A still further object of the present invention is to provide a negative chargeable developer which does not cause a partially white image even under a low electric field such as one used in a reversal development device, and is excellent in durability, and also an image forming method using the developer.

According to the present invention, there is provided a negative chargeable developer for developing electrostatic latent images, comprising:

a toner, and hydrophobic silica fine powder treated with an agent represented by the following compositional formula (I):

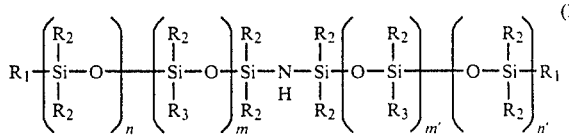

(I)

wherein $R_1$ denotes an alkyl or alkoxy group, $R_2$ denotes an alkyl group having 1–3 carbon atoms, $R_3$ denotes a long-chain alkyl group, a halogen-substituted alkyl group, phenyl group, or a phenyl group having a substituent, and m, n, m′ and n′ are independently 0 or a position integer satisfying the relationships of $n>m$, $n'>m'$ and $n+m+n'+m'<30$.

According to another aspect of the present invention, there is provided an image forming method, comprising:

forming an electrostatic image on a photosensitive member, developing the electrostatic image with a negative chargeable developer to form a toner image, the developer comprising a toner and hydrophobic silica fine powder treated with an agent represented by the following compositional formula (I):

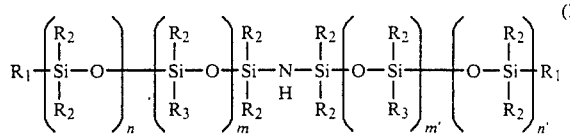

(I)

wherein $R_1$ denotes an alkyl or alkoxy group, $R_2$ denotes an alkyl group having 1–3 carbon atoms, $R_3$ denotes a long-chain alkyl group, a halogen-substituted alkyl group, phenyl group, or a phenyl group having a substituent, and m, n, m′ and n′ are independently 0 or a position integer satisfying the relationships of $n>m$, $n'>m'$ and $n+m+n'+m'<30$; and electrostatically transferring the toner image thus formed to a transfer material under the application of a transfer-charging electric field Vtr providing a ratio Vtr/Vpr with respect to a primary charging electric field Vpr satisfying the relationships that the ratio Vtr/Vpr is negative and has an absolute value within the range of 0.5–1.6.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
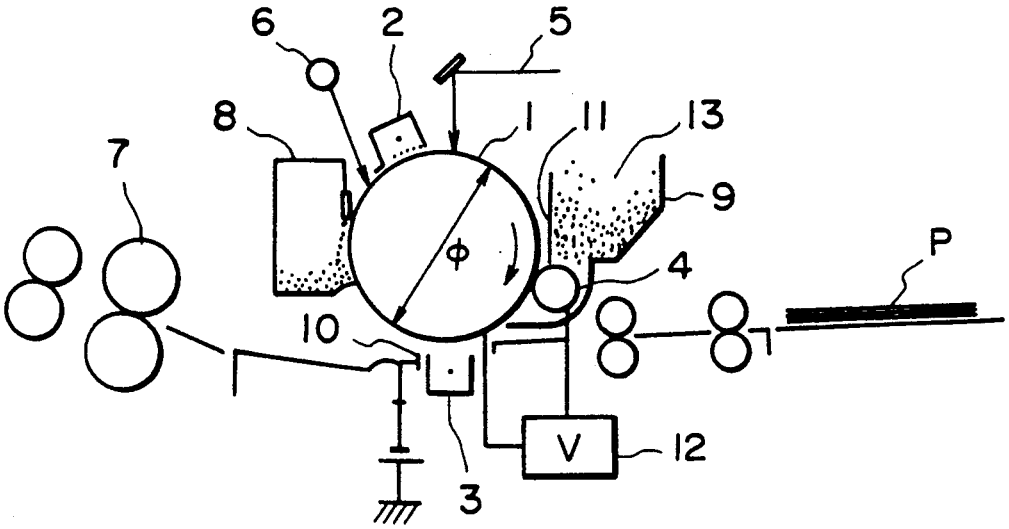
FIG. 1 is a schematic sectional view showing an image forming apparatus used in Examples of the invention appearing thereinafter.

We have found that a satisfactory performance in the transfer step of the reversal development system is obtained by incorporating the hydrophobic silica fine powder treated with the above-mentioned treating agent of the formula (I) and high quality images free from white spots due to agglomerated silica in image parts are obtained.

The silica fine powder as a constituent of the developer of the present invention may be prepared from silica fine powder produced by the dry process or the wet process.

The dry process referred to herein is a process for producing silica fine powder through vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the silica fine powder to be used in the present invention.

Commercially available silica fine powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | MOX 170 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica (Dow Corning Co.) | |
| Fransol (Fransil Co.) | |
| Reolosil (Tokuyama Soda K.K.) | |

On the other hand, in order to produce silica fine powder to be used in the present invention through the wet process, various processes known heretofore may be applied. For example, decomposition of sodium silicate with an acid represented by the following scheme may be applied:

$$Na_2O{\cdot}xSiO_2+HCl+H_2O \rightarrow SiO_2{\cdot}nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silica, a process wherein a sodium silicate solution is treated with an ion-exchange resin to form silica, and a process wherein natural silica or silicate is utilized.

The silica fine power to be used herein may include anhydrous silicon dioxide (silica in a narrow sense), and also a silicate such as aluminum silicate, sodium silicate, potassium silicate, magnesium silicate and zinc silicate.

Commercially available silica fine powders formed by the wet process include those sold under the trade names as shown below:

Carplex (available from Shionogi Seiyaku K.K.)
Nipsil (Nippon Silica K.K.)
Tokusil, Finesil (Tokuyama Soda K.K.)
Bitasil (Tagi Seishi K.K.)
Silton, Silnex (Mizusawa Kagaku K.K.)
Starsil (Kamishima Kagaku K.K.)
Himesil (Ehime Yakuhin K.K.)
Siloid (Fuji Devison Kagaku K.K.)
Hi-Sil (Pittsuburgh Plate Glass Co.)
Durosil, Ultrasil (Fulstoff-Gesellshaft Marquart)
Manosil (Hardman and Holden)
Hoesch (Chemische Fabrik Hoesch K-G)
Sil-Stone (Stoner Rubber Co.)
Nalco (Nalco Chem. Co.)
Quso (Philadilphia Quartz Co.)
Imsil (Illinois Minerals Co.)
Calcium Silikat (Chemische Fabrik Hoesch, K-G)
Calsil (Fullstoff-Gesellschaft Marquart)
Fortafil (Imperial Chemical Industries)
Microcal (Joseph Crosfield & Sons. Ltd.)
Manosil (Hardman and Holden)
Vulkasil (Farbenfabriken Bayer, A.G.)
Tufknit (Durham Chemicals, Ltd.)
Silmos (Shiraishi K.K.)
Starlex (Kamishima Kagaku K.K.)
Furikosil (Tagi Seihi K.K.)

Among the above-mentioned silica powders, those having a specific surface area as measured by the BET method with nitrogen adsorption of 30 $m^2/g$ or more, particularly 50–400 $m^2/g$, provides a good result.

The hydrophobicity-imparting agent for treating such silica fine powder to obtain the hydrophobic silica fine powder contained in the developer of the present invention is one having a composition represented by the above formula (I).

In the formula (I), the group $R_1$ may preferably be an alkyl group or alkoxy group having 1–4 carbon atoms. The group $R_3$ may preferably be a long-chain alkyl group having 5–20 carbon atoms, a halogen-substituted alkyl group having 5–20 carbon atoms, phenyl group, or phenyl group having a substituent. It is particularly preferred that $R_3$ is a long-chain alkyl group having 8–18 carbon atoms.

In case wherein $n'+m'+n+m$ is 30 or more in the formula (I), the treating agent is caused to have a high viscosity so that silica agglomerates are produced to cause white spots in image parts. When contained in the developer.

The hydrophobicity-imparting agent (or treating agent) of the formula (I) has a a high hydrophobicity-imparting ability equivalent to that of dimethylsilicone oil and also a high lubricating ability imparting a good effect in respect of transfer characteristic of the developer. Further, the treating agent of the formula (I) has a high reactivity with the silanol groups on the silica surface which is comparable to that of hexamethyldisilazane. The treating agent may preferably have a viscosity of 70 cS (centistokes) or below, particularly 50 cS or below, at 25° C. so as to obviate formation of silica agglomerates at the time of the treatment.

As a preferred specific form, the treating agent may assume the following formula:

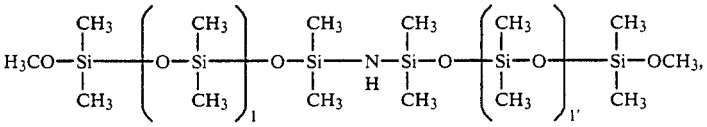

wherein 1+1′ is preferably 4–20. A commercially available example of the treating agent is "X-24-3504" (trade name) available from Shin-etsu Kagaku Kogyo K.K., Japan.

The treatment with the hydrophobicity-imparting agent may be performed in a conventional manner. For example, the silica fine powder and the treating agent may be directly mixed by a mixer such as Henschel mixer, or the treating agent may be sprayed onto the silica fine powder. The treating agent can also be dissolved or dispersed in an appropriate solvent and then mixed with the silica fine powder, followed by removing the solvent to complete the treatment. In the present invention, the treating agent may preferably be used in a proportion of 1–40 wt. parts, more preferably 5–30 wt. parts, per 100 wt. parts of the silica fine powder.

The silica fine powder used in the present invention should have a high anti-(water)-wettability. The anti-wettability is measured in the following manner. A sample in an amount of 0.1 g is placed in a 200 ml-separating funnel, and 100 ml of de-ionized water taken in a messcylinder is added thereto. The mixture is shaken for 10 min. by a Turbula Shaker Mixer model T2C at a rate of 90 r.p.m. The separating funnel is then allowed to stand still for 10 min., and 20–30 ml of the content is withdrawn from the bottom. A portion of the remaining water is taken in a 10 mm-cell and the turbidity of the water is measured by a colorimeter (wavelength: 500 nm) in comparison with deionized water as a blank. The ratio of the transmittance of the water sample to that of the blank in term of % (percent) is denoted as the anti-wettability. A higher anti-wettability indicates that the silica fine powder has a higher hydrophobicity.

The silica used in the developer of the present invention should preferably have an anti-wettability of 80 % or higher, particularly 90 % or higher. If the anti-wettability is below 80 %, high-quality images cannot be attained because of moisture absorption by the silica fine powder under a high-humidity condition.

The hydrophobic silica fine powder used in the present invention may preferably have a triboelectric chargeability of −100 to −300 uC/g.

It is also preferred that the hydrophobic silica is added in a proportion of 0.01–3.0 wt. parts per 100 wt. parts of the toner. Below 0.01 wt. part, a sufficient effect of the addition cannot be exhibited to result in a problem during development and transfer. Above 3.0 wt. parts, fog is undesirable increased. The addition amount is particularly preferably 0.1–2.0 wt. parts per 100 wt. parts of the toner.

The hydrophobic silica contained in the developer of the present invention is characterized in that it moves together with the toner. This is utterly different from the function of particles in a metal disclosed by Japanese Laid-Open Patent Application No. 60470/1981 wherein the particles are urged to be disposed at non-image parts to lower the force of attachment between a transfer material and a photosensitive member.

According to the method of Japanese Laid-Open Patent Application No. 60470/1981, the paper winding can be alleviated without lowering the transfer electric field. This method however is not effective for "after image caused by paper" nor is it effective for increasing the transfer efficiency in a low transfer electric field.

In the transfer step used in the present invention, there may be used an electrostatic transfer method using an electric field generated by a corona charger or a contact roller charger. The transfer condition may be determined in the following manner.

Referring to FIG. 1, a cleaning device 8, a developing device 9 and a transfer charger 3 are removed from an image forming device shown in FIG. 1, a photosensitive member (photosensitive drum) 1 as an electrostatic image-bearing member is charged by means of a primary charger 2. Under a condition under which leakage light is substantially perfectly intercepted, the surface of the photosensitive member 1 corresponding to one rotation thereof is charged and thereafter the surface potential of the photosensitive member 1 is measured by means of a surface electrometer. The surface potential measured at this time is represented by Vpr (V). Then, the photosensitive member surface is wiped with a cloth impregnated with alcohol to discharge (or remove charges from) the photosensitive member 1 surface, the primary charger 2 is removed and the transfer charger 3 is disposed. Thereafter, the surface of the photosensitive member 1 corresponding to one rotation thereof is charged and then the surface potential of the photosensitive member 1 is measured by means of a surface electrometer. The surface potential measured at this time is represented by Vtr (V).

In the transfer step used in the present invention, the ratio of (Vtr/Vpr) may preferably be negative, and the absolute value of Vtr/Vpr (i.e., Vtr/Vpr) may more preferably be 0.5–1.6, particularly preferably 0.9–1.4. When the above-mentioned absolute value is below 0.5, the transfer electric field is too weak and image deterioration is liable to occur at the time of transfer. When the absolute value exceeds 1.6, the transfer electric field is too strong and the photosensitive member is liable to be charged positively, whereby "afterimage caused by paper" and paper winding are liable to occur.

The present invention may effectively be used in an image forming method or apparatus using a photosensitive member comprising an organic photoconductor (hereinafter, referred to as "OPC photosensitive member"), and may more effectively be used in an image forming method using a reversal development system and a laminate-type OPC photosensitive member which comprises plural layers including at least a charge generation layer and a charge transport layer. In the OPC photosensitive member, when the photosensitive layer is charged to have a polarity reverse to that of primary charging, the movement of charges is slow. In the laminate-type OPC photosensitive member, because such a tendency is intensified and the above-mentioned after-image due to paper is liable to occur, the present invention is particularly effective.

In the present invention, the above-mentioned Vpr may preferably be −300 to −1000 (V), more preferably −500 to −900 (V). Below −300 (V), it is difficult to ensure a potential difference suitable for development and the resultant image tends to become unclear. Above −1000 V, dielectric breakdown in the photosensitive layer due to an electric field occurs and image deterioration such as black spots is liable to occur. In view of durability, Vpr may preferably be −500 to −900 (V). On the other hand, it is preferred to regulate Vtr to a voltage of 150 to 1600 V, more preferably 250 to 1400 V.

The image forming method according to the present invention is particularly suitable for an image forming method or apparatus wherein a transfer material such as paper is separated from a photosensitive member by using the elasticity of the transfer material, the curvature of the photosensitive member, or a charge-removing brush, without using mechanical separation means. In the apparatus having no mechanical separation mechanism, because the separation state depends on the transfer condition and paper winding is liable to occur, the present invention is particularly effective.

Figure 2:
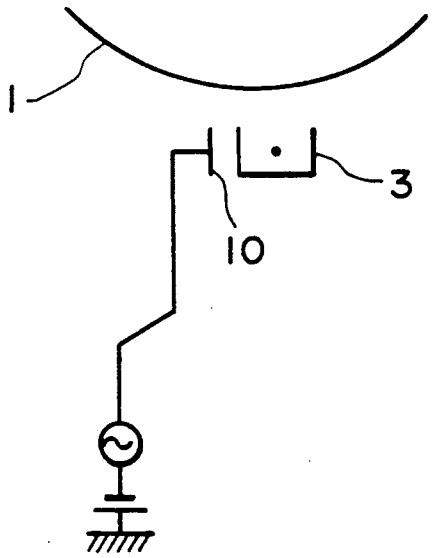
FIG. 2 is an enlarged schematic sectional view showing transfer position of the above apparatus wherein an AC bias and a DC bias are applied to a discharge brush.

The present invention is particularly effective with respect to an image forming method (or apparatus) using a photosensitive member 101 having a diameter (i.e., "ϕ" in FIG. 1) of 50 mm or smaller. In the apparatus using a photosensitive drum having a diameter of 50 mm or smaller, because the number of parts are required to be reduced in view of miniaturization, the separation step is generally conducted by using the elasticity of transfer paper and a charge-removing brush 10 as shown in FIG. 2. In such an embodiment, the charge-removing step only discharges the paper, and, in general, the surface potential of the photosensitive member 1 is not affected thereby.

Now, a preferred embodiment of the image forming step according to the present invention is described with reference to FIGS. 1 and 2.

Referring to FIG. 1, the surface of a photosensitive member (drum) 1 is charged negatively by means of a primary charger 2, and then exposure light 5 generated by a light source or laser (not shown) is supplied to the photosensitive member 1 surface according to an image scanning method thereby to form a latent image thereon. The latent image is developed with a negatively chargeable one-component magnetic developer 13 to form a toner image in a developing position where a developing sleeve 4 of a developing device 9 is disposed opposite to the photosensitive member 1 surface. The developing device 9 comprises a magnetic blade 11 and the developing sleeve 4 having a magnet (not shown) inside thereof, and contains the developer 13. In the developing position, a bias is applied between the photosensitive drum 1 and the developing sleeve 4 by bias application means 12, as shown in FIG. 1.

As shown in FIG. 1, when a transfer paper P is conveyed to a transfer position where a transfer charger 3 confronts the photosensitive drum 1, the back side surface of the transfer paper P (i.e., the surface thereof opposite to that confronting the photosensitive drum 1) is charged positively by means of the transfer charger 3, whereby the toner image comprising a negatively chargeable toner formed on the photosensitive drum 1 surface is electrostatically transferred to the transfer paper P.

Immediately after the transfer paper P passes through the transfer charger 3, the transfer paper P is separated from the photosensitive drum 1 by curvature separation while removing the charges on the backside surface of the transfer paper P by means of a charge-removing brush. Then, the transfer paper P separated from the photosensitive drum 1 is conveyed to a fixing device 7 using heat and pressure rollers thereby to fix the toner image to the transfer paper P.

The residual one-component developer remaining on the photosensitive drum 1 downstream of the transfer position is removed by a cleaner 8 having a cleaning blade. The photosensitive drum 1 after the cleaning is discharged by erasing exposure 6, and again subjected to the above-mentioned process including the charging step based on the primary charger 2, as the initial step.

Next, the negatively chargeable toner used in the present invention will be explained.

The binder resin for the toner of the present invention may be composed of homopolymers of styrene and derivatives thereof such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-methyl α-chloromethacrylate copolymer, styrene-dimethylaminoethyl methacrylate copolymer, styrene-vinyl methylether copolymer, styrene-vinyl ethyl ether copolymer, styrene-vinyl methyl ketone copolymer, styrenebutadiene copolymer, styrene-isoprene copolymer, styrene-maleic copolymer, and styrene-maleic acid ester copolymer; vinyl polymers or copolymers such as polymethyl methacrylate, polybutyl methacrylate, polyvinyl acetate, polyethylene, polypropylene, polyesters, polyurethanes, polyamides, epoxy resins, polyvinyl butyral, polyacrylic acid resin and mixtures thereof. Further, there may be used rosin, modified rosins, terpene resin, phenolic resins, aliphatic or alicyclic hydrocarbon resins, aromatic petroleum resin, chlorinated paraffin, paraffin wax, carnauba wax etc. These binder resins may be used either singly or as a mixture.

Among these, in the present invention, the binder may preferably comprise a styrene-acrylic resin-type copolymer (inclusive of styrene-acrylic acid ester copolymer and styrene-methacrylic acid ester copolymer) or a polyester resin. Particularly preferred examples include styrene-n-butyl acrylate (St-nBA) copolymer, styrene-n-butyl methacrylate (St-nBMA) copolymer, styrene-n-butyl acrylate-2-ethylhexyl methacrylate copolymer St-nBA-2EHMA) copolymer in view of the developing characteristic, triboelectric chargeability and fixing characteristic of the resultant toner.

The toner of the present invention can further contain an optional colorant such as known carbon black, copper phthalocyanine, and iron black.

The magnetic material contained in the magnetic toner of the present invention may be a substance which is magnetizable under a magnetic field including: powder of a ferromagnetic metal such as iron, cobalt and nickel; or an alloy or compound such as magnetite, $\gamma$-$Fe_2O_3$, and ferrite, or an alloy of iron, cobalt or nickel. The magnetic fine powder may preferably have a BET specific surface area of 2–20 $m^2/g$, more preferably 2.5–12 $m^2/g$, and may further preferably have a Mohs' scale of hardness of 5–7.

The magnetic powder content may preferably be 10–70 wt. % based on the toner weight.

The toner according to the present invention may also contain as desired, a charge controller (or charge-controlling agent) including a negative charge controller such as a metal complex salt of a monoazo dye; and a metal complex of salicylic acid, alkylsalicylic acid, dialkylsalicylic acid, or naphthoic acid, etc. The toner of the present invention may preferably contain 0.1–10 wt. parts, more preferably 0.1–5 wt. parts, of the charge controller, per 100 wt. parts of a binder resin.

The magnetic toner of the present invention may preferably have a volume resistivity of $10^{10}$ ohm.cm or more, more preferably $10^{12}$ ohm.cm or more, particularly preferably $10^{14}$ ohm.cm or more, in view of triboelectric chargeability and electrostatic transfer characteristic. The volume resistivity used herein may be determined in the following manner. Thus, the toner is shaped into a sample having an area of 2 $cm^2$ and a thickness of about 5 mm under a pressure of 100 $kg/cm^2$ for 5 min., and an electric field of 100 V/cm is applied thereto. After 1 min. counted from the application of the electric field, the amount of the current passing through the shaped toner is measured and converted into a volume resistivity.

The negatively chargeable magnetic toner according to the present invention may preferably provide a triboelectric charge of $-8$ $\mu C/g$ to $-40$ $\mu C/g$, more preferably $-8$ $\mu C/g$ to $-20$ $\mu C/g$. If the charge is less than $-8$ $\mu C/g$ (in terms of the absolute value thereof), the image density is liable to decrease, particularly under a high humidity condition. If the charge amount is more than $-20$ $\mu C/g$, particularly more than $-40$ $\mu C/g$, the toner is excessively charged to make a line image thinner, whereby only a poor image is provided particularly under a low humidity condition.

The triboelectric chargeability of a sample (which may be silica fine powder or a toner) used in the present invention may be measured as follows. The sample is mixed with iron powder carrier having particle sizes of 200 to 300 mesh (e.g., EFV 200/300, mfd. by Nippon Teppun K.K.) is mixed in a proportion of 2/98 for silica (or 10/90 for a toner), and the mixture is shaked for about 20 seconds. The weight of the mixture in the range of 0.5–1.5 $m^2$ is accurately weighed, placed on a 400-mesh metal screen connected to a electro-meter and sucked under a pressure of 25 cm-$H_2O$. The triboelctric charge of the sample is calculated from the amount of the sample sucked through the screen and the charge thereof.

The toner particles may preferably have a 10 volume-average particle size of 5–30 microns, more preferably 6–15 microns, particularly preferably 7–15 microns. The toner particles may preferably have a number-basis particle size distribution such that they contain 1–25 % by number, more preferably 2 to 20 % by number, particularly preferably 2 to 18 % by number, of toner particles having a particle size of 4 microns or smaller.

In the present invention, the particle distribution of the toner may be measured by means of a Coulter counter.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1 %-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 0.5 to 50 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner of the present invention may be obtained.

The toner of the present invention may for example be prepared in the following manner.

Pulverization Process (1) A binder resin and a magnetic material or dye or pigment as a colorant and other additive as desired are blended by uniform dispersion by means of a blender such as Henschel mixer.

(2) The above blended mixture is subjected to melt-kneading by using a kneading means such as a kneader, extruder, or roller mill.

(3) The kneaded product is coarsely crushed by means of a crusher such a cutter mill or hammer mill and then finely pulverized by means of a pulverizer such as a jet mill.

(4) The finely pulverized product is subjected to classification for providing a prescribed particle size distribution by means of a classifier such as a zigzag classifier, thereby to provide a toner.

As another process for producing the toner of the present invention, the polymerization process or the encapsulation process, etc., can be used. The outline of these processes is summarized as follows.

Polymerization Process (1) A monomer composition comprising a polymerizable monomer, a polymerization initiator and a colorant, may be dispersed into particles in an aqueous dispersion medium.

(2) The particles of the monomer composition are classified into an appropriate particle size range.

(3) The monomer composition particles within a prescribed particle size range after the classification is subjected to polymerization.

(4) After the removal of a dispersant through an appropriate treatment, the polymerized product is filtered, washed with water and dried to obtain a toner.

Encapsulation Process (1) A binder resin and a colorant such as a magnetic material, are melt-kneaded to form a toner core material in a molten state.

(2) The toner core material is stirred vigorously in water to form fine particles of the core material.

(3) The fine core particles are dispersed in a solution of a shell material, and a poor solvent is added thereto under stirring to coat the core particle surfaces with the shell material to effect encapsulation.

(4) The capsules obtained above are recovered through filtration and drying to obtain a toner.

The present invention will be explained in further detail based on Examples wherein "parts" are by weight.

EXAMPLE 1

| | |
|---|---|
| Styrene-n-butyl acrylate copolymer (copolymerization wt. ratio = 8:2) | 100 parts |
| Magnetic power (magnetite) | 60 parts |
| Release agent (polypropylene wax) | 4 parts |
| Negative charge control agent (Cr complex of di-tertiary-butyl-salicylic acid) | 2 parts |

The above components were mixed and melt-kneaded by means of a biaxial extruder heated at 160° C. The kneaded product was cooled and then coarsely crushed by means of a hammer mill and finely pulverized by means of a jet-mill (wind-force pulverizer). The finely pulverized product was classified by means of a DS classifier (wind-force classifier) thereby to prepare a magnetic toner comprising black fine powder having a volume-average particle size of 11.5 microns.

The triboelectric charge of the magnetic toner with respect to iron powder carrier was measured to be −13 μC/g.

Separately, dry process silica fine powder (BET specific surface area: 200 $m^2/g$) was treated with a treating agent of the following formula (II) (having a viscosity of 20 cps at 25° C.) in the following manner.

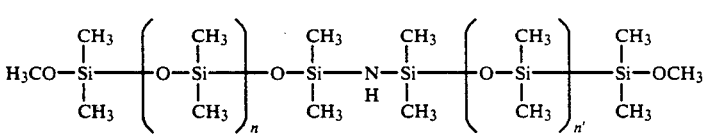

(II)

(n + n' = 10)

1) 100 parts of the silica fine powder was stirred in a mixing vessel.

2) 20 parts of the treating agent was diluted with xylene into 4 times, and the resultant 80 parts of dilute solution was sprayed onto the silica fine powder stirred in the mixing vessel.

3) The contents of the vessel was heated to 300° C. and held for 2 hours under stirring.

4) After cooling, the thus hydrophobicity-imparted silica fine powder was taken out.

The hydrophobic silica fine powder A thus obtained showed an anti-wettability of 93 % and a triboelectric charge of −170 μC/g. The hydrophobic silica fine powder A in an amount of 0.4 part was added to 100 parts of the above-prepared magnetic toner, and the mixture was blended in a Henschel mixer to obtain a negatively chargeable one-component type dry developer.

Separately, a commercially available copying machine (FC-5, available from Canon K.K.; having a laminated negatively chargeable OPC photosensitive drum with a drum diameter of 30 mm, of a curvature separation type and with a discharge needle supplied with a bias voltage of −1.0 KV) was remodeled for reversal development (FIG. 1). The above-prepared developer was loaded on the remodeled copying machine, and image formation was effected under the conditions including a primary charging electric field Vpr of −700 V and a ratio |Vtr/Vpr| of 1.0 (corresponding to a transfer charging electric field Vtr=+700 V), a spacing between the photosensitive drum and the developing drum (containing a magnet), and application of an AC bias (f=1800 Hz, Vpp=1600 V) and a DC bias ($V_{DC}$=−500 V) to the developing drum. After the image formation and heat-pressure roller fixation, the resultant fixed toner images were evaluated with respect to the following items; and the results are summarized in Table 1 appearing hereinafter together with the results of other Examples.

a) Image density

The image density on a 1000-th sheet of ordinary copying paper (75 $g/m^2$) was evaluated.

α(good): 1.35 or above,

Δ(fair): 1.0 to 1.34, x (not good): below 1.0.

b) Transfer state

Thick paper of 120 $g/m^2$ providing a severe transfer condition was passed, and transfer failure was α: Good, Δ: Practically acceptable, x: Practically not acceptable.

c) Power winding 1000 sheets of thin paper (50 $g/m^2$) were passed, and the occurrence of paper jam was examined.

α: none or once/1000 sheets

Δ: 2–4 times/1000 sheets x: 5 or more times/1000 sheets d) After image caused by paper.

Solid images were copied and the uniformity thereof was evaluated.

α: Density different =0.05 or less

Δ: Density different =0.06–0.15 x: Density different =0.16 or more.

e) Image quality

Toner scattering and coarsening were observed with naked eyes.

EXAMPLE 2

Image formation was effected in the same manner as in Example 1 except that the ratio of Vtr/Vpr was changed to −0.5. The results are shown in Table 1 appearing hereinafter.

EXAMPLE 3

TABLE 1

| | Vtr/Vpr | Silica | 23.5° C., 60% Image density | Transfer state | Paper winding | After image | White spots | Image quality | 32.5° C., 85% Image density | Transfer state |
|---|---|---|---|---|---|---|---|---|---|---|
| Ex. | | | | | | | | | | |
| 1 | −1.0 | A | ○ | ○ | ○ | ○ | ○ | ○ | ○ | ○ |
| 2 | −0.5 | A | ○ | ○ | ○ | ○ | ○ | Δ | ○ | Δ |
| 3 | −1.6 | A | ○ | ○ | ○ | Δ | ○ | ○ | ○ | ○ |
| 4 | −1.0 | B | ○ | ○ | ○ | ○ | Δ | ○ | ○ | ○ |
| 5 | −1.0 | C | ○ | ○ | ○ | ○ | ○ | ○ | ○ | ○ |
| Comp. Ex. | | | | | | | | | | |
| 1 | −1.0 | Untreated | Δ | x | ○ | ○ | ○ | x | x | x |
| 2 | −1.0 | D | ○ | ○ | ○ | ○ | x | ○ | ○ | ○ |
| 3 | −1.0 | E | ○ | Δ | ○ | ○ | ○ | ○ | Δ | x |
| Ref. Ex. 1 | −2.0 | A | ○ | ○ | Δ | x | ○ | Δ | ○ | ○ |
| Ref. Ex. 2 | −0.3 | A | ○ | x | ○ | ○ | ○ | x | Δ | x |

TABLE 2

| | Silica before treatment BET ($m^2/g$) | Treating agent, in formula (I) n + n' | m + m' | $R_1$ | $R_2$ | $R_3$ | Treated silica (25° C.) viscosity (cs) | Tribo-electric charge (μc/g) | Anti-wettability (%) |
|---|---|---|---|---|---|---|---|---|---|
| Silica | | | | | | | | | |
| A | 200 | 10 | 0 | methoxy | methyl | — | 20 | −150 | 90 |
| B | 200 | 25 | 0 | methoxy | methyl | — | 50 | −170 | 93 |
| C | 200 | 10 | 2 | methyl | methyl | decyl | 28 | −160 | 92 |
| D | 200 | dimethylsilicone oil | | | | | 100 | −190 | 97 |
| E | 200 | hexamethyldisilazane | | | | | 5 | −120 | 87 |

Image formation was effected in the same manner as in Example 1 except that the ratio of Vtr/Vpr was changed to −1.6. The results are also shown in Table 1.

EXAMPLES 4 and 5

Image formation was effected in the same manner as in Example 1 except that hydrophobic silica fine powders B and C shown in Table 2 applying hereinafter were respectively used instead of the hydrophobic silica fine powder A to prepare developer. The results are also shown in Table 1.

COMPARATIVE EXAMPLE 1

A developer was prepared in the same manner as in Example 1 except that the dry silica fine powder before the treatment (BET surface area = 200 $m^2/g$) was used a it was instead of the hydrophobic silica fine powder A, and image formation was effected in the same manner by using the developer. The results are also shown in Table 1.

COMPARATIVE EXAMPLES 2 and 3

Developers were prepared in the same manner as in Example 1 except that hydrophobic silica fine powders D and E, respectively, shown in Table 2 were used instead of the hydrophobic silica fine powder A. The results are also shown in Table 1.

REFERENCE EXAMPLES 1 AND 2

Image formation was effected in the same manner as in Example 1 except that the transfer conditions were changed to provide ratios Vtr/Vpr of −2.0 and −0.3, respectively. The results are also shown in Table 1.

What is claimed is:

1. A negative chargeable developer for developing electrostatic latent images, comprising:

a toner, and hydrophobic silica fine powder treated with an agent represented by the following compositional formula (I):

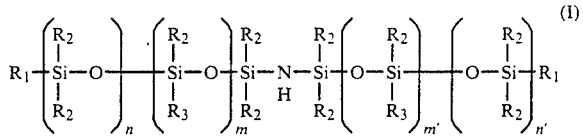

(I)

wherein $R_1$ denotes an alkyl or alkoxy group, $R_2$ denotes an alkyl group having 1-3 carbon atoms, $R_3$ denotes a long-chain alkyl group, a halogen-substituted alkyl group, phenyl group, or a phenyl group having a substituent, and m, n, m' and n' are independently 0 or a positive integer satisfying the relationships of $n>m$, $n'>m'$ and $n+m+n'+m'<30$.

2. A developer according to claim 1, wherein in the formula (I) representing the agent, $R_1$ is an alkyl or alkoxy group having 1-4 carbon atoms, $R_3$ is an alkyl or halogen-substituted alkyl group having 5-20 carbon atoms.

3. A developer according to claim 2, wherein $R_3$ is an alkyl group having 8-18 carbon atoms.

4. A developer according to claim 1, wherein the agent is represented by the following formula:

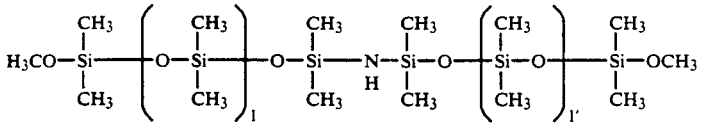

wherein 1 and 1' are positive integers satisfying the relationship of $1+1'=4$ to 20.

5. A developer according to claim 1, wherein the agent has a viscosity at 25° C. of 70 centi-stokes or below.

6. A developer according to claim 1, wherein the agent has a viscosity at 25° C. of 50 centi-stokes or below.

7. A developer according to claim 1, wherein the hydrophobic silica fine powder has been obtained by treating 100 wt. parts of silica fine powder with 1–40 wt. parts of the agent.

8. A developer according to claim 1, wherein the hydrophobic silica fine powder has been obtained by treating 100 wt. parts of silica fine powder with 5–30 wt. parts of the agent.

9. A developer according to claim 1, wherein the hydrophobic silica fine powder has an anti-water-wettability of 80 % or higher.

10. A developer according to claim 1, wherein the hydrophobic silica fine powder has an anti-water-wettability of 90 % or higher.

11. A developer according to claim 1, wherein said toner is a negatively chargeable toner.

12. A developer according to claim 1, wherein said toner is a negatively chargeable magnetic toner.

13. A developer according to claim 1, wherein said toner has a triboelectric chargeability of −8 to −20 μc/g.

14. A developer according to claim 1, which comprises 0.01–3.0 wt. parts of the hydrophobic silica fine powder per 100 wt. parts of the toner.

15. A developer according to claim 1, which comprises 0.1–2.0 wt. parts of the hydrophobic silica fine powder per 100 wt. parts of the toner.

16. A developer according to claim 1, wherein said toner comprises a styrene-acrylic resin-type copolymer or a polyester resin as a binder resin.

17. A developer according to claim 1, which comprises 100 wt. parts of the toner and 0.01–3.0 wt. parts of the hydrophobic silica fine powder;

the toner is a negatively chargeable magnetic toner comprising a binder resin and magnetic powder and has a volume resistivity of $10^{12}$ ohm.cm or higher; and the hydrophobic fine powder has been obtained by treating 100 wt. parts of silica fine powder with 1 −40 wt. parts of an agent represented by the formula:

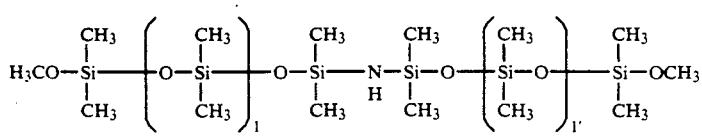

wherein 1 and 1' are positive integers satisfying the relationship of $1+1'=4$ to 20.

18. A developer according to claim 17, wherein the toner comprises a styrene-acrylic resin-type copolymer or a polyester resin as a binder resin and has a triboelectric chargeability of −8 to −20 μc/g.

19. An image forming method, comprising:

forming an electrostatic image on a photosensitive member, developing the electrostatic image with a negative chargeable developer to form a toner image, the developer comprising a toner and hydrophobic silica fine powder treated with an agent represented by the following compositional formula (I):

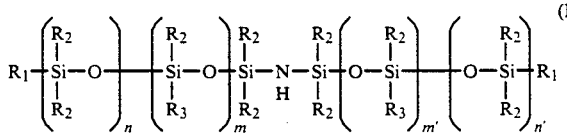

(I)

wherein $R_1$ denotes an alkyl or alkoxy group, $R_2$ denotes an alkyl group having 1–3 carbon atoms, $R_3$ denotes a long-chain alkyl group, a halogen-substituted alkyl group, phenyl group, or a phenyl group having a substituent, and m, n, m' and n' are independently 0 or a positive integer satisfying the relationships of $n>m$, $n'>m'$ and $n+m+n'+m'<30$; and electrostatically transferring the toner image thus formed to a transfer material under the application of a transfer-charging electric field Vtr providing a ratio Vtr/Vpr with respect to a primary charging electric field Vpr satisfying the relationships that the ratio Vtr/Vpr is negative and has an absolute value within the range of 0.5–1.6.

20. A method according to claim 19, wherein the photosensitive member is a laminated, negatively chargeable photosensitive member, a negatively charged electrostatic image is formed on the photosensitive member, the developer is a negatively chargeable developer, and the negatively charged electrostatic image is developed by the developer by reversal development.

21. A method according to claim 20, wherein the photosensitive member comprises a photosensitive drum having a diameter of 50 mm or smaller.

22. A method according to claim 19, wherein Vpr is −300 to −1000 volts.

23. A method according to claim 19, wherein Vpr is −500 to −900 volts.

24. A method according to claim 19, wherein the absolute value of Vtr/Vpr is 0.9–1.4.

25. A method according to claim 19, wherein in the formula (I) representing the agent, $R_1$ is an alkyl or alkoxy group having 1–4 carbon atoms, $R_3$ is an alkyl or halogen-substituted alkyl group having 5–20 carbon atoms.

26. A method according to claim 25, wherein $R_3$ is an alkyl group having 8–18 carbon atoms.

27. A method according to claim 19, wherein the agent is represented by the following formula

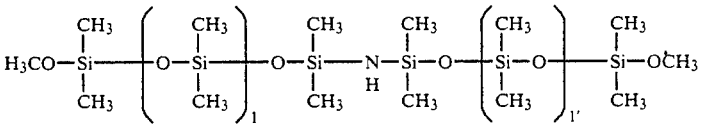

wherein 1 and 1′ are positive integers satisfying the relationship of $-1+1'=4$ to 20.

28. A method according to claim 19, wherein the agent has a viscosity at 25° C. of 70 centi-stokes or below.

29. A method according to claim 19, wherein the agent has a viscosity at 25° C. of 50 centi-stokes or below

30. A method according to claim 19, wherein the hydrophobic silica fine powder has been obtained by treating 100 wt. parts of silica fine powder with 1 treat 40 wt. parts of the agent.

31. A method according to claim 19, wherein the hydrophobic silica fine powder has been obtained by treating 100 wt. parts of silica fine powder with 5–30 wt. parts of the agent.

32. A method according to claim 19, wherein the hydrophobic silica fine powder has an anti-water-wettability of 80 % or higher.

33. A method according to claim 19, wherein the hydrophobic silica fine powder has an anti-water-wettability of 90 % or higher.

34. A method according to claim 19, wherein said toner is a negatively chargeable toner.

35. A method according to claim 19, wherein said toner is a negatively chargeable magnetic toner.

36. A method according to claim 19, wherein said toner has a triboelectric chargeability of −8 to −20 μc/g.

37. A method according to claim 19, wherein the developer comprises 0.01–3.0 wt. parts of the hydrophobic silica fine powder per 100 wt. parts of the toner.

38. A method according to claim 19, wherein the developer comprises 0.1–2.0 wt. parts of the hydrophobic silica fine powder per 100 wt. parts of the toner.

39. A method according to claim 19, wherein said toner comprises a styrene-acrylic resin-type copolymer or a polyester resin as a binder resin.

40. A method according to claim 19, wherein the developer comprises 100 wt. parts of the toner and 0.01–3.0 wt. parts of the hydrophobic silica fime powder;

the toner is a negatively chargeable magnetic toner comprising a binder resin and magnetic powder and has a volume resistivity of $10^{12}$ ohm.cm or higher; and the hydrophobic fine powder has been obtained by treating 100 wt. parts of silica fine powder with 1–40 wt. parts of an agent represented by the formula:

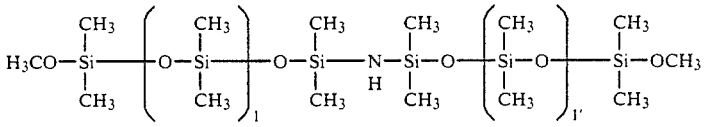

wherein 1 and 1′ are positive integers satisfying the relationship of $1+1'=4$ to 20.

41. A method according to claim 40, wherein the toner comprises a styrene-acrylic resin-type copolymer or a polyester resin as a binder resin and has a triboelectric chargeability of −8 to −20 μc/g.

* * * * *

UNITED STATES PATENT AND TRADEMARK OFFICE

CERTIFICATE OF CORRECTION

PATENT NO. : 5,043,239

DATED : August 27, 1991

INVENTOR(S) : TSUTOMU KUKIMOTO

It is certified that error appears in the above-identified patent and that said Letters Patent is hereby corrected as shown below:

Title Page:

IN [56] REFERENCES CITED

FOREIGN PATENT DOCUMENTS, "1402010 8/1985" should read --1402010 8/1975--.

COLUMN 1

Line 30, "computer" should read --a computer--.
Line 39, "use" should read --used--.

COLUMN 2

Line 23, "cleaning" should read --a cleaning--.
Line 28, "4353648)" should read --4,353,648)--.

COLUMN 3

Line 13, "air" should read --the air--.
Line 18, "Applications" should read --Application--.
Line 24, "chlorsilane" should read --chlorosilane--.
Line 31, "tranferabil-" should read --transferabil- --.

COLUMN 4

Line 30, "position" should read --positive--.
Line 55, "position" should read --positive--.

COLUMN 5

Line 1, "DRAWING" should read --DRAWINGS--.
Line 16, "and" should read --and that--.

UNITED STATES PATENT AND TRADEMARK OFFICE

CERTIFICATE OF CORRECTION

PATENT NO. : 5,043,239

DATED : August 27, 1991

INVENTOR(S) : TSUTOMU KUKIMOTO

It is certified that error appears in the above-identified patent and that said Letters Patent is hereby corrected as shown below:

COLUMN 6

Line 29, "Pittsuburgh" should read --Pittsburgh--.
Line 35, "Philadilphia" should read --Philadelphia--.
Line 44, "Shiraishi" should read --Shiraishi Kogyo--.
Line 64, "case" should read --the case--.
Line 67, "parts. When" should read --parts when--.

COLUMN 7

Line 64, "uC/g." should read --μC/g.--.

COLUMN 8

Line 2, "undesirable" should read --undesirably--.
Line 57, "Vtr/Vpr)" (second occurrence) should read --|Vtr/Vpr|)--.

COLUMN 9

Line 19, "-1000 V," should read -- -1000 (V),--.
Line 39, "member 101" should read --member 1--.

COLUMN 11

Line 16, "¶ The" should read --The--.
Line 57, "is mixed" should be deleted.
Line 58, "shaked" should read --shaken--.
Line 61, "a electro-meter" should read --an electrometer--.
Line 62, "triboelctric" should read --triboelectric--.

UNITED STATES PATENT AND TRADEMARK OFFICE

CERTIFICATE OF CORRECTION

PATENT NO. : 5,043,239

DATED : August 27, 1991

INVENTOR(S) : TSUTOMU KUKIMOTO

It is certified that error appears in the above-identified patent and that said Letters Patent is hereby corrected as shown below:

COLUMN 12

Line 37, "additive" should read --additives--.
Line 64, "is" should read --are--.

COLUMN 14

Line 27, "α(good):" should read --O(good):--.
Line 33, "α:Good," should read --O:Good,--.
Line 39, "α:none" should read --O:none--.
Line 42, "paper." should read --paper:--.
Line 57, "α:Density" should read --O:Density--.

COLUMN 15

Line 54, "a" should read --as--.

COLUMN 19

Line 15, "-1+1'=4 to 20." should read --1+1'= 4 to 20.--.
Line 24, "1 treat" should read --1- --.

UNITED STATES PATENT AND TRADEMARK OFFICE

CERTIFICATE OF CORRECTION

PATENT NO. : 5,043,239

DATED : August 27, 1991

INVENTOR(S) : TSUTOMU KUKIMOTO

It is certified that error appears in the above-identified patent and that said Letters Patent is hereby corrected as shown below:

COLUMN 20

LIne 34, "fime" should read --fine--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*